US006716494B2

(12) United States Patent
Nakanishi et al.

(10) Patent No.: US 6,716,494 B2
(45) Date of Patent: Apr. 6, 2004

(54) TRANSFER SHEETS

(75) Inventors: Hideki Nakanishi, Takaishi (JP); Noboru Yamada, Suwa (JP); Junichi Iida, Suwa (JP)

(73) Assignees: Seiko Epson Corporation, Tokyo (JP); Daicel Chemical Industries, Ltd., Osaka (JP)

( * ) Notice: Subject to any disclaimer, the term of this patent is extended or adjusted under 35 U.S.C. 154(b) by 26 days.

(21) Appl. No.: 10/214,776

(22) Filed: Aug. 9, 2002

(65) Prior Publication Data

US 2003/0068477 A1 Apr. 10, 2003

(30) Foreign Application Priority Data

Aug. 9, 2001 (JP) ..... 2001-242243

(51) Int. Cl.[7] ..... B41M 5/30

(52) U.S. Cl. ..... 428/32.12; 428/32.3; 428/32.7; 428/32.86

(58) Field of Search ..... 428/32.12, 32.3, 428/32.7, 32.86

(56) References Cited

FOREIGN PATENT DOCUMENTS

| | | | |
|---|---|---|---|
| EP | 0 805 049 | A1 | 11/1997 |
| EP | 0 850 786 | A2 | 7/1998 |
| EP | 1 114 734 | A1 | 7/2001 |
| JP | A-9-290560 | | 11/1997 |
| JP | A-10-16382 | | 1/1998 |
| JP | A-2000-168250 | | 6/2000 |
| WO | 01/43977 | A1 | 6/2001 |

*Primary Examiner*—B. Hamilton Hess
(74) *Attorney, Agent, or Firm*—Birch, Stewart, Kolasch & Birch, LLP

(57) ABSTRACT

A transfer sheet comprises a support, and a transfer layer separable from the support and receivable an ink, wherein the transfer layer contains a hot-melt adhesive particle. The hot-melt adhesive particle in the transfer sheet comprises a particle having a melting point of more than 80° C. (A) and a particle having a melting point of not more than 80° C. (B), and the particle (A) comprises a hot-melt adhesive particle having an oil absorption of not less than 50 ml/100 g (A1) and a hot-melt adhesive particle having an oil absorption of less than 50 ml/100 g (A2). Further, the transfer layer may comprise a film-formable resin component and a dye fixing agent. The transfer sheet is excellent in stability on delivery of a sheet, so prevents the inside of the printer from staining, and excels in ink-absorption to a degree that the stain transfer does not occur.

16 Claims, No Drawings

TRANSFER SHEETS

FIELD OF THE INVENTION

The present invention relates to a transfer sheet for an ink jet printer useful in forming a record image with the use of an ink jet printer and transferring the record image to an object (to be transferred) such as clothes (or member), a method for transferring a record image with use of the same, and a fabric(s) or clothes (e.g., woven fabrics) on which a record image is formed by the method for transferring.

BACKGROUND OF THE INVENTION

Since an ink jet recording system is easily applicable to full-color image production, and is less noisy and superior in print quality, the system has been employed for recording an image onto a transfer sheet. From the viewpoints of safety and suitability for recording, a water-based ink is predominantly employed in the ink jet recording, and the recording is carried out by ejecting droplets of ink from a nozzle against a sheet. Therefore, the sheet requires high ink-absorption ability and ink-fixability.

For example, when an ink which is difficult to dry up in a short time is employed, there is possibility that the ink is stuck on a sheet-feeding roller of an ink jet printer. In particular, in the case of using a deep-color ink and a pale- or light-color ink in combination and forming (or printing) a pale- or light-color area adjacent to a deep-color area, the deep-color ink is stuck on a roller even in a small amount, and further the stuck deep-color ink is stuck on the pale-color area by contacting with the revolving roller, so that the pale-color area is contaminated to deteriorate an outward appearance. Such a phenomenon is called as stain transfer.

Furthermore, for carrying out stable print with the use of an ink jet printer having an elaborative mechanism, it is necessary for a sheet to have stability in delivery of a paper and stability of a coating layer (or coat film) on the sheet. If a paper is not delivered stably, a printer is clogged with the paper and it is difficult to form or print a clear or sharp image, and if the coating layer on the sheet comes off at the inside of the printer, the inside of the printer is stained, as a result delivery of a paper or image formation is adversely affected.

On the other hand, for example, when a record image is thermal-transferred to an object such as clothes to form a transfer image by means of this transfer sheet, not only thermal transferability and adhesiveness but also high water resistance and washing resistance are required of a transfer layer of the sheet.

For example, Japanese Patent Application Laid-Open No. 16382/1998 (JP-10-16382A) discloses a transfer medium for an ink jet recording which comprises a support (or substrate), a release layer and a transfer layer containing a fine particle of a thermoplastic resin and a polymeric adhesive of a thermoplastic resin disposed on the support. However, in the transfer medium, the fine particle is liable to come off the transfer layer, the inside of the printer is apt to be stained, and stain transfer also occurs. Further, the transfer medium is inadequate in ink-fixability and water resistance.

Moreover, Japanese Patent Application Laid-Open No. 290560/1997 (JP-9-290560A) discloses an image-receiving sheet for ink jet comprising a release support and a transfer layer formed on the release support, wherein the transfer layer contains a filler particle, a water-soluble thermoplastic resin and if necessary, a water-insoluble thermoplastic resin. However, the sheet is inadequate in thermal transferability and adhesiveness. Moreover, the fine particle is liable to come off the transfer layer. Further, strain transfer occurs, and the transfer layer of the sheet is inadequate in ink-fixability, water resistance, and the texture after transcription.

Furthermore, Japanese Patent Application Laid-Open No. 168250/2000 (JP-2000-168250A) discloses a thermal-transfer sheet which comprises a support, and an ink-receiving layer which is capable of separating from the support, contains at least a thermosetting resin and a hot-melt adhesive resin and is formed on at least one side of the support. However, stability in delivery of the sheet is not enough, and strain transfer occurs.

Accordingly, an object of the present invention is to provide a transfer sheet for an ink jet printer which has excellent stability in delivery of a paper, prevents the inside of the printer from staining, and excels in ink-absorption to a degree that stain transfer does not occur.

It is another object of the present invention is to provide a transfer sheet for an ink jet printer which is excellent in thermal transferability and adhesiveness.

It is still another object of the present invention is to provide a transfer sheet for an ink jet printer which is excellent in water resistance, and excellent in texture in case of thermal-transferring to an object (e.g., clothes, fabrics).

SUMMARY OF THE INVENTION

The inventors of the present invention did intensive research, and finally found that by forming a transfer layer, which comprises specific three kinds or species of hot-melt adhesive fine particles on a support, both stability in delivery of a paper of a transfer sheet for an ink jet printer and stainless of the inside of the printer can be dramatically improved and ink-absorption can be improved to such a degree that the stain transfer does not occur. The present invention was accomplished based on the above findings.

That is, the transfer sheet of the present invention comprises a support, and a transfer layer separable from the support and receivable an ink (e.g., an ink droplet), wherein the transfer layer contains a hot-melt adhesive particle. The hot-melt adhesive particle comprises a particle having a melting point of more than 80° C. (A) and a particle having a melting point of not more than 80° C. (B), and the particle (A) comprises a hot-melt adhesive particle having an oil absorption of not less than 50 ml/100 g (A1) and a hot-melt adhesive particle having an oil absorption of less than 50 ml/100 g (A2). The melting point of the particle (A) may be about 90 to 120° C. (in particular, about 100 to 120° C.), and the melting point of the particle (B) may be about 30 to 80° C. (in particular, about 60 to 80° C.). The oil absorption of the particle (A1) is about 70 to 500 ml/100 g (in particular, about 100 to 300 ml/100 g), and the oil absorption of the particle (A2) is not more than 48 ml/100 g (in particular, not less than 47 ml/100 g). The weight ratio of the particle (A) relative to the particle (B) is about 99.9/0.1 to 30/70 (in particular, about 99.5/0.5 to 50/50). The weight ratio of the particle (A1) relative to the particle (A2) is about 80/20 to 1/99 (in particular, about 60/40 to 5/95). The particle (A) and the particle (B) each may comprise a polyamide-series particle (polyamide-series fine particle). The transfer layer may further comprise a film-formable (film-forming) resin component. The film-formable resin component may comprise a hydrophilic polymer, a urethane-series resin, a thermosetting or crosslinkable (crosslinking) resin, and the like. The transfer layer may further comprise a dye fixing agent.

The present invention includes a method for recording or forming an image onto a recording medium with an ink composition, wherein the recording medium comprises the transfer layer of the transfer sheet.

The present invention includes a transfer sheet in which an image is recorded onto the transfer layer of the transfer sheet by an ink jet recording system. Moreover, the present invention includes a method for transferring a record image to an object, which comprises bringing the transfer layer of the transfer sheet into contact with the object, heating the transfer layer, and peeling the transfer layer from a support for transferring the record image to the object. Further, the present invention includes a fabric or clothes, on which a record image is formed by the transferring method.

DETAILED DESCRIPTION OF THE INVENTION

The transfer sheet for an ink jet printer of the present invention comprises a support and a transfer layer separable from the support and containing a hot-melt adhesive particle.

[Support]

As a support (or substrate), any of supports such as opaque, semitransparent and transparent supports can be used as far as the transfer layer (or the protecting layer) is capable of separating (or releasing) from the support. Examples of the support usually include a release (releasable) support, for example, a release-treated paper (a release paper), a synthetic paper, a chemical (artificial) fiber paper and a plastic film, and each may be treated for providing releasability.

As a synthetic paper, there may be mentioned, a variety of synthetic papers such as a paper made with a polypropylene, a polystyrene or the like.

As a chemical fiber paper, there may be mentioned, a variety of chemical fiber papers made with chemical fibers such as a nylon fiber, an acrylic fiber, a polyester fiber and a polypropylene fiber.

As a polymer constituting the plastic film, a variety of resins (a thermoplastic resin and a thermosetting resin) can be used, and a thermoplastic resin is usually employed. As the thermoplastic resin, there may be mentioned a polyolefin-series (polyolefinic) resin (e.g., a poly$C_{2-4}$olefin-series resin such as a polypropylene), a cellulose derivative (e.g., a cellulose ester such as a cellulose acetate), a polyester-series resin (e.g., a polyalkylene terephthalate such as a polyethylene terephthalate and a polybutylene terephthalate, a polyalkylene naphthalate such as a polyethylene naphthalate and a polybutylene naphthalate, or a copolyester thereof), a polyamide-series resin (e.g., a polyamide 6, a polyamide 6/6), a vinyl alcohol-series resin (e.g., a polyvinyl alcohol, an ethylene-vinyl alcohol copolymer), a polycarbonate, and the like. Among these films, the polypropylene, the polyester-series resin, the polyamide-series resin or the like is usually employed. In particular, the polyester-series resin (especially, a polyethylene terephthalate) is preferred from viewpoints of mechanical strength, heat resistance and workability.

The thickness of the support can be selected according to its use or application, and is usually, for example, about 10 to 250 $\mu$m, and preferably about 15 to 200 $\mu$m.

The releasability can be provided or imparted by a conventional method, for example, by treating the support with a releasing agent (e.g., a wax, a salt of a higher fatty acid, an ester of a higher fatty acid, an amide of a higher fatty acid, a silicone oil) or by allowing the releasing agent containing in the support. In case of the paper, the releasability can be imparted by coating the paper with a releasing agent (e.g., a silicone oil) after anchor treatment (e.g., clay-coat). If necessary, to the plastic film may be added a conventional additive such as a stabilizer (e.g., an antioxidant, an ultraviolet ray absorber, a thermal stabilizer), a lubricant, a nucleation agent, a filler and a pigment.

[Transfer Layer]

In the transfer sheet of the present invention, the transfer layer contains a hot-melt adhesive particle and further may contain a film-formable (film-forming) resin component, and a dye fixing agent.

(Hot-melt Adhesive Particle)

The hot-melt adhesive particle comprises a hot-melt adhesive fine particle (hot-melt adhesive particle) having a melting point of more than 80° C. (A) and a hot-melt adhesive fine particle (hot-melt adhesive particle) having a melting point of not more than 80° C. (B).

(A) Hot-melt Adhesive Fine Particle

The melting point of the hot-melt adhesive fine particle (A) need only to be more than 80° C. For example, the melting point is about 90 to 200° C., preferably about 90 to 120° C., and more preferably about 100 to 120° C. Moreover, the hot-melt adhesive fine particle (A) comprises a hot-melt adhesive fine particle (hot-melt adhesive particle) having an oil absorption of not less than 50 ml/100 g (A1) and a hot-melt adhesive fine particle (hot-melt adhesive particle) having an oil absorption of less than 50 ml/100 g (A2).

(A1) Hot-melt Adhesive Fine Particle

The hot-melt adhesive fine particle (A1) mainly gives stability in delivery of a paper, and high ink-absorption to a transfer layer, and also imparts hot-melt adhesiveness to the transfer layer.

The oil absorption of the hot-melt adhesive fine particle (A1) is not less than 50 ml/100 g (e.g., about 70 to 500 ml/100 g), and preferably not less than 75 ml/100 g (e.g., about 100 to 300 ml/100 g). Incidentally, the oil absorption is a value measured by use of linseed oil in accordance with JIS K 5107.

Moreover, the specific surface area of the hot-melt adhesive fine particle (A1) is about 5 to 100 $m^2/g$ (e.g., about 10 to 50 $m^2/g$), and preferably about 10 to 40 $m^2/g$.

A hot-melt adhesive fine particle (A1) which satisfies such properties is a porous hot-melt adhesive fine particle.

The hot-melt adhesive resin includes a variety of resins, for example, an olefinic resin (e.g., a polyethylene, an ethylene-propylene copolymer, an atactic polypropylene), an ethylene copolymeric resin [e.g., an ethylene-vinyl acetate copolymer, an ethylene-(meth)acrylic acid copolymer, an ethylene-ethyl acrylate copolymer, an ionomer], a polyamide-series resin, a polyester-series resin, a polyurethane-series resin, an acrylic resin, a rubber and the like. The hot-melt adhesive resin may be used singly or in combination. The hot-melt adhesive resin is usually water-insoluble. The hot-melt adhesive resin may be a reactive hot-melt adhesive resin having a reactive group (e.g., a carboxyl group, a hydroxyl group, an amino group, an isocyanate group, and a silyl group) at a terminal position.

The preferred resin for imparting the thermal-transferability and durability (e.g., washing resistance) is a polyamide-series resin, a polyester-series resin, a polyurethane-series resin. In particular, when an object (to be transferred) is clothes or the like, a hot-melt adhesive resin composed of a polyamide-series resin can provide a transfer image with excellent washing resistance and water resistance, and superior texture.

As the polyamide-series hot-melt adhesive resin, there may be mentioned a nylon 6, a nylon 46, a nylon 66, a nylon 610, a nylon 612, a nylon 11, a nylon 12, a polyamide resin formed by reacting a dimer acid with a diamine, a polyamide-series elastomer (e.g., a polyamide with a polyoxyalkylene diamine as a soft segment). The polyamide-series resin may be used singly or in combination. Among them, the preferred polyamide-series resin includes a nylon obtainable from at least one monomer unit selected from monomer units constituting a nylon 11 and a nylon 12 (e.g., a homopolyamide such as a nylon 11 and a nylon 12, a copolyamide such as a nylon 6/11, a nylon 6/12, a nylon 66/12, a copolymer of a dimer acid, a diamine and a laumlactam or aminoundecanoic acid), a polyamide resin obtained by reacting a dimer acid with a diamine.

The polyester-series hot-melt adhesive resin includes a homopolyester resin, a copolyester resin and a polyester-series elastomer, which employ at least an aliphatic diol or an aliphatic dicarboxylic acid. The homopolyester resin includes a saturated aliphatic polyester resin obtained by reacting an aliphatic diol (e.g., a $C_{2-10}$alkylene diol such as ethylene glycol, propylene glycol, 1,4-butanediol and 1,6-hexanediol, a polyoxy$C_{2-4}$alkylene glycol such as diethylene glycol), with an aliphatic dicarboxylic acid (e.g., a $C_{4-14}$aliphatic dicarboxylic acid such as adipic acid, suberic acid, azelaic acid, sebacic acid and dodecanedicarboxylic acid), and if necessary, a lactone (e.g., butyrolactone, valerolactone, caprolactone and laurolactone). The copolyester resin includes a saturated polyester resin obtained by substituting part of components (a diol component and/or a terephthalic acid) constituting a polyethylene terephthalate or a polybutylene terephthalate with the other diols (e.g., a $C_{2-6}$alkylene glycol such as ethylene glycol, propylene glycol and 1,4-butanediol, a polyoxyalkylene glycol such as diethylene glycol and triethylene glycol, cyclohexanedimethanol) or the other dicarboxylic acids (e.g., the above aliphatic dicarboxylic acid, an asymmetric aromatic dicarboxylic acid such as phthalic acid and isophthalic acid), or the above lactones. The polyester-series elastomer includes an elastomer having a $C_{2-4}$alkylene arylate (e.g., ethylene terephthalate, butylene terephthalate) as a hard segment and a (poly)oxyalkylene glycol or the like as a soft segment. A polyester resin having a urethane bond, for example, a resin which is polymerized with the use of the diisocyanate may be employed as the polyester-series resin. The polyester can be used singly or in combination.

The polyurethane-series hot-melt adhesive resin includes a polyurethane resin obtained with the use of, as at least one part of diol component, the polyester diol corresponding to the polyester-series hot-melt adhesive resin. An aromatic, an araliphatic, an alicyclic or an aliphatic diisocyanate can be used as the diisocyanate component. The polyurethane can be used singly or in combination.

In order to give hot-melt adhesiveness effectively by protruding the hot-melt adhesive fine particle (A1) from the transfer layer surface, the hot-melt adhesive fine particle may comprise a particulate or powdery resin having a larger mean particle size than the thickness of the transfer layer. The mean particle size of the fine particle is, for example, about 1 to 200 $\mu$m, preferably about 10 to 150 $\mu$m, and more preferably about 30 to 100 $\mu$m.

(A2) Hot-melt Adhesive Fine Particle

The hot-melt adhesive fine particle (A2) mainly imparts stability in delivery of a sheet and high hot-melt adhesiveness to the transfer layer.

The oil absorption of the hot-melt adhesive fine particle (A2) is less than 50 ml/100 g, preferably not more than 48 ml/100 g, and more preferably not more than 47 ml/100 g (e.g., about 10 to 47 ml/100 g).

The kind or species of hot-melt adhesive resins constituting the hot-melt adhesive fine particle (A2) and the mean particle size of the fine particle are similar to those of the hot-melt adhesive fine particle (A1).

The ratio of the hot-melt adhesive fine particle (A1) relative to the hot-melt adhesive fine particle (A2) (weight ratio) is [(A1)/(A2)=] about 80/20 to 1/99, preferably about 60/40 to 5/95, and more preferably about 40/60 to 10/90 (in particular, about 30/70 to 15/85).

(B) Hot-melt Adhesive Fine Particle

The hot-melt adhesive fine particle (B) prevents the hot-melt adhesive fine particle (A) from coming off the transfer layer, increases running property at the inside of the printer, and imparts hot-melt adhesiveness.

The melting point of the hot-melt adhesive fine particle (B) is not more than 80° C. (e.g., about 30 to 80° C.), preferably about 40 to 80° C., and more preferably about 50 to 80° C. (particularly, about 60 to 80° C.). The hot-melt adhesive fine particle (B) allows to stably keep the hot-melt adhesive fine particle (A) on the transfer layer, probably because the hot-melt adhesive fine particle (B) is melted in the production step of the transfer layer and participates in forming of the layer.

There is no particular restriction as to the mean particle size of the hot-melt adhesive fine particle (B). The mean particle size of the hot-melt adhesive fine particle (B) can be suitably selected from the range of about 1 to 300 $\mu$m, and is usually about 1 to 200 $\mu$m, preferably about 10 to 150 $\mu$m, and more preferably about 30 to 100 $\mu$m similar to that of the hot-melt adhesive fine particle (A). Moreover, the kind or species of the hot-melt adhesive resins is similar to that of the hot-melt adhesive fine particle (A1).

The ratio of the hot-melt adhesive fine particle (A) relative to the hot-melt adhesive fine particle (B) (weight ratio) is about 99.9/0.1 to 30/70, preferably about 99.5/0.5 to 50/50, and more preferably about 99/1 to 70/30 (in particular, about 98/2 to 80/20).

The amount of the hot-melt adhesive particle is, on solid basis, about 10 to 10,000 parts by weight (e.g., about 10 to 5,000 parts by weight), preferably about 10 to 3,000 parts by weight (e.g., about 10 to 2,000 parts by weight), more preferably about 100 to 1,000 parts by weight (e.g., about 150 to 1,000 parts by weight), and usually about 150 to 5,000 parts by weight relative to 100 parts by weight of the film-formable resin component.

(Film-formable Resin Component)

The film-formable resin component is not particularly limited as far as it has the film-formable properties, a variety of thermoplastic resins (e.g., a polyamide-series resin, a polyester-series resin, a styrenic resin, an polyolefinic resin, a cellulose derivative, a polycarbonate-series resin, a polyvinyl acetate-series resin, an acrylic resin, a vinyl chloride-series resin, a thermoplastic urethane-series resin) and thermosetting resins can be used. Among the film-formable resin components, at least one selected from the group consisting of a hydrophilic polymer, a urethane-series resin, and a thermosetting or a crosslinkable (crosslinking) resin is preferred. The film-formable resin component can be used singly or in combination.

(1) Hydrophilic Polymer

The transfer layer may contain a hydrophilic polymer in order to make an ink retainability better.

The hydrophilic polymer includes a variety of polymers having an affinity for water, for example, a water-soluble polymer, a water-dispersible polymer, and a polymer which is water-insoluble and has water-absorbing.

As the hydrophilic polymer, there may be mentioned, for example, a polyoxyalkylene glycol-series resin (a polyoxy$C_{2-4}$alkylene glycol such as a polyethylene glycol, a polypropylene glycol, an ethylene oxide-propylene oxide block copolymer, and a polytetramethylene ether glycol), an acrylic polymer [e.g., a poly(meth)acrylic acid or a salt thereof, a methyl methacrylate-(meth)acrylic acid copolymer, an acrylic acid-polyvinylalcohol copolymer], a vinyl ether-series polymer (e.g., a polyvinyl alkyl ether such as a polyvinyl methyl ether and a polyvinyl isobutyl ether, a $C_{1-6}$alkyl vinyl ether-maleic anhydride copolymer), a styrenic polymer [e.g., a styrene-maleic anhydride copolymer, a styrene-(meth)acrylic acid copolymer, a polystyrenesulfonic acid or a salt thereof], a vinyl acetate-series polymer (e.g., a vinyl acetate-(meth)acrylic acid copolymer, a vinyl acetate-methyl acrylate copolymer), a vinyl alcohol-series polymer (a polyvinyl alcohol, a modified polyvinyl alcohol, an ethylene-vinyl alcohol copolymer), a cellulose derivative (e.g., a cellulose ether such as methyl cellulose, ethyl cellulose, hydroxyethyl cellulose, and carboxymethyl cellulose, a cellulose ester such as cellulose acetate), a hydrophilic natural polymer or a derivative thereof (e.g., alginic acid or a salt thereof, a gum arabic, a gelatin, a casein, a dextrin), a nitrogen-containing polymer (or cationic polymer) or a salt thereof [e.g., a quaternary ammonium salt such as a polyvinylbenzyltrimethylannmonium chloride, and a polydiallyldimethylammonium chloride, a polydimethylaminoethyl (meth)acrylate hydrochloride, a polyvinylpyridine, a polyethylene imine, a polyacryl amide, a polyvinyl pyrrolidone]. The salt of the hydrophilic polymer (in particular, a salt of carboxyl group or sulfonic acid group) includes an ammonium salt, an amine salt, and an alkali metal salt such as sodium salt. The hydrophilic polymer can be used singly or in combination.

Among the hydrophilic polymers, a hydroxyl group-containing hydrophilic polymer [for example, a polyoxyalkylene glycol-series resin, a vinyl alcohol-series polymer (a polyvinyl alcohol, a modified polyvinyl alcohol), a cellulose derivative (e.g., hydroxyethylcellulose)], a carboxyl group-containing hydrophilic polymer (e.g., an acrylic polymer), a nitrogen-containing polymer (e.g., a cationic polymer, a polyvinylpyrrolidone), in particular, a polyoxyalkylene glycol-series resin are preferred. As a polyoxyalkylene glycol-series resin, a polyoxyalkylene glycol-series resin having an oxyethylene unit is preferred, and for example, there may be mentioned a polyethylene glycol (homopolymer), or a copolymer of ethylene oxide and at least one selected from the group consisting of a $C_{3-4}$alkylene oxide, a hydroxyl group-containing compound (e.g., a polyhydric alcohol such as glycerin, trimethylolpropane, trimethylolethane and bisphenol A), a carboxyl group-containing compound (e.g., a $C_{2-4}$carboxylic acid such as acetic acid, propionic acid, butyric acid) and an amino group-containing compound (e.g., an amine, an ethanolamine). The weight-average molecular weight of the hydrophilic polymer is about 100 to 50,000, preferably about 500 to 10,000, and more preferably about 1,000 to 5,000.

(2) Urethane-series Resin

The transfer layer may further contain a urethane-series resin for excellent texture (softness).

The urethane-series resin comprises, for example, a urethane-series polymer obtained by reacting a diisocyanate component with a diol component, and if necessary, a diamine component may be used as a chain-extending agent.

As the diisocyanate component, there may be mentioned an aromatic diisocyanate (e.g., phenylene diisocyanate, tolylene diisocyanate, diphenylmethane-4,4'-diisocyanate), an araliphatic diisocyanate (e.g., xylylene diisocyanate), an alicyclic diisocyanate (e.g., isophorone diisocyanate), an aliphatic diisocyanate (e.g., 1,6-hexamethylene diisocyanate, lysine diisocyanate). An adduct of a diisocyanate compound may be used as the diisocyanate component. If necessary, a polyisocyanate component such as triphenylmethane triisocyanate may be used in combination. The diisocyanate component may be used singly or in combination.

As examples of the diol component, there may be mentioned a polyester diol, a polyether diol, a polycarbonate diol. The diol component may be used singly or in combination.

The polyester diol may be a polyester diol derived from a lactone, not being limited to a polyester diol obtained by reacting a diol with a dicarboxylic acid or a reactive derivative thereof (e.g., a lower alkyl ester, an acid anhydride). As examples of the diol, there may be mentioned an aliphatic diol (e.g., a $C_{2-10}$alkylene diol such as ethylene glycol, trimethylene glycol, propylene glycol, 1,3-butanediol, 1,4-butanediol, hexamethylene glycol and neopentyl glycol; a polyoxy$C_{2-4}$alkylene glycol such as diethylene glycol and triethylene glycol), an alicyclic diol and an aromatic diol. The diol may be used singly or in combination. If necessary, a polyol such as trimethylol propane and pentaerythritol may be used in combination with the above diol. The diol is usually an aliphatic diol.

As examples of the dicarboxylic acid, there may be mentioned an aliphatic dicarboxylic acid (e.g., a $C_{4-14}$aliphatic dicarboxylic acid such as adipic acid, suberic acid, azelaic acid, sebacic acid, dodecanedicarboxylic acid), an alicyclic dicarboxylic acid, an aromatic dicarboxylic acid (e.g., phthalic acid, terephthalic acid, isophthalic acid). The dicarboxylic acid may be used singly or in combination. If necessary, a polycarboxylic acid such as trimellitic acid and pyromelitic acid may be used in combination with the dicarboxylic acid.

As examples of the lactone, there may be mentioned butyrolactone, valerolactone, caprolactone and laurolactone. The lactone may be used singly or in combination.

The urethane-series resin may be a polyether-based urethane-series resin obtained with the use of a polyether diol (e.g., a polyoxytetramethyleneglycol) as a diol component, and a polyester-based urethane-series resin obtained with the use of at least a polyester diol (in particular, an aliphatic polyester diol obtained with use of an aliphatic component as a main reaction component) is preferred, and the polyester-based urethane-series resin includes, for example, a urethane resin obtained by reacting a diisocyanate such as isophorone diisocyanate with a polyester diol, which is obtained by reacting a $C_{2-6}$alkylene diol such as 1,4-butandiol, with a $C_{4-12}$aliphatic dicarboxylic acid such as adipic acid and isophthalic acid or phthalic acid, or a polyester diol, which is derived from the above lactone.

It is preferred that the urethane-series resin is used as an organic solvent solution, an aqueous solution, an aqueous emulsion. The aqueous solution or the aqueous emulsion of the urethane-series resin may be prepared by dissolving or emulsion-dispersing a urethane-series resin with the use of an emulsifying agent, or by introducing an ionic functional group such as a free carboxyl group and a tertiary amino group into a molecule of a urethane-series resin and dissolving or dispersing the urethane-series resin with the use of an alkali or an acid. Such a urethane-series resin in which a free carboxyl group or a tertiary amino group is introduced into its molecule comprises a urethane-series resin obtained by reacting a diisocyanate component with a diol component having a free carboxyl group or a tertiary amino group (in particular, a polymeric diol). Incidentally, the diol having a free carboxyl group (in particular, a polymeric diol) can be obtained by a process which comprises reacting a diol component with a polycarboxylic acid or an anhydride thereof having three or more carboxyl groups (e.g., a tetrabasic or tetracarboxylic acid anhydride such as pyromellitic acid anhydride) or a polycarboxylic acid having a sulfonic acid group (e.g., sulfoisophthalic acid), or a process which comprises ring-opening-polymerizing a lactone with the use of dimethylol propionic acid as an initiator. Moreover, the diol having a tertiary amino group (especially, a polymeric diol) can be prepared by ring-opening-polymerizing an alkyleneoxide or a lactone with the use of N-methyldiethanolamine or the like as an initiator. The tertiary amino group may form a quaternary ammonium salt. Such a urethane-series polymer into which a tertiary amino group or a quaternary ammonium salt is introduced [a cation-type urethane-series resin (cationic urethane-series resin)] is commercially available as, for example, F-8559D (manufactured by Daiichi Kogyo Seiyaku, Co. Ltd.), PERMARIN UC-20 (manufactured by Sanyo Kasei Kogyo, Co. Ltd.). The urethane-series resin may be used singly or in combination.

(3) Thermosetting Resin or Crosslinkable Resin

A thermosetting resin or a crosslinkable resin may be, for example, a phenolic resin, an alkyd resin, an unsaturated polyester resin, an epoxy-series resin, a vinyl ester-series resin, a silicone-series resin or the like, and a self-crosslinkable (self-crosslinking) resin (a thermoplastic resin having a self-crosslinking group), for example, a self-crosslinking polyester-series resin, a self-crosslinking polyamide-series resin, a self-crosslinking acrylic resin, a self-crosslinking olefinic resin and the like are preferred. Among them, a self-crosslinking acrylic resin (e.g., an acrylic silicone resin) is particularly preferred.

The self-crosslinkable (self-crosslinking) resin comprises a polymer composed of a monomer having at least a self-crosslinking group [e.g., an epoxy group, a methylol group, a hydrolyzed condensate group (e.g., silyl group), an aziridinyl group] as a constituting unit.

A monomer having the self-crosslinking group (i.e., a monomer containing a crosslinking functional group) includes a variety of monomers, for example, an epoxy group-containing monomer [e.g., glycidyl (meth)acrylate, (meth)allyl glycidyl ether, 1-allyloxy-3,4-epoxybutane, 1-(3-butenyloxy)-2,3-epoxypropane, 4-vinyl-1-cyclohexane-1,2-epoxide], a methylol group-containing monomer or a derivative thereof [e.g., an N-$C_{1-4}$alkoxymethyl (meth)acrylamide such as N-methylol (meth) acrylamide, and N-methoxymethyl (meth)acrylamide, N-butylol (meth)acrylamide], a monomer containing a hydrolyzed condensate group such as silyl group [e.g., vinyltrimethoxysilane, vinyltriethoxysilane, vinyltributoxysilane, vinylmethoxydimethylsilane, vinylethoxydimethylsilane, vinylisobutoxydimethylsilane, vinyldimethoxymethylsilane, vinyldiethoxymethylsilane, vinyltris(2-methoxyethoxy)silane, vinyldiphenylethoxysilane, vinyltriphenoxysilane, 3-(vinylphenylaminopropyl)trimethoxysilane, 3-(vinylbenzylaminopropyl)trimethoxysilane, 3-(vinylphenylaminopropyl)triethoxysilane, 3-(vinylbenzylaminopropyl)triethoxysilane, divinyldimethoxysilane, divinyldiethoxysilane, divinyldi(2-methoxyethoxy)silane, vinyldiacetoxymethylsilane, vinyltriacetoxysilane, vinylbis(dimethylamino) methylsilane, vinylmethyldichlorosilane, vinyldimethylchlorosilane, vinyltrichlorosilane, vinylmethylphenylchlorosilane, allyltriethoxysilane, 3-allylaminopropyltrimethoxysilane, allyldiacetoxymethylsilane, allyltriacetoxysilane, allylbis (dimethylamino)methylsilane, allylmethyldichlorosilane, allyldimethylchlorosilane, allyltrichlorosilane, methallylphenyldichlorosilane, 2-(meth) acryroxyethyltrimethoxysilane, 2-(meth) acryroxyethyltriethoxysilane, 3-(meth) acryroxypropyltrimethoxysilane, 3-(meth) acryroxypropyltriethoxysilane, 3-(meth) acryroxypropylmethyldimethoxysilane, 3-(meth) acryroxypropylmethyldichlorosilane, 3-(meth) acryroxypropyltris(2-methoxyethoxy)silane], an aziridinyl group-containing monomer [e.g., 2-(1-aziridinyl)ethyl (meth)acrylate, 2-(1-aziridinyl)propyl (meth)acrylate, 3-(1-aziridinyl)propyl (meth)acrylate]. The monomer containing a crosslinking functional group can be used singly or in combination.

The preferred monomer containing a crosslinking functional group has a hydrolyzed condensate group, in particular, an alkoxysilyl group (e.g., a $C_{1-4}$alkoxy silyl group such as methoxysilyl group, ethoxysilyl group). An acrylic resin having the above hydrolyzed condensate group is preferred as the thermosetting or crosslinking resin.

The thermosetting or crosslinking resin may comprise a copolymer obtainable from the monomer containing a crosslinking functional group and the other monomers (e.g., a monomer such as a monomer containing a cationic functional group, a hydrophilic monomer, a nonionic monomer).

As the monomer containing a cationic functional group, there may be mentioned, for example, a di$C_{1-4}$alkylamino-$C_{2-3}$alkyl(meth)acrylamide or a salt thereof [e.g., dimethylaminoethyl(meth)acrylamide, diethylaminoethyl (meth)acrylamide, dimethylaminopropyl(meth)acrylamide, diethylaminopropyl(meth)acrylamide], a di$C_{1-4}$alkylamino-$C_{2-3}$alkyl(meth)acrylate or a salt thereof [e.g., dimethylaminoethyl(meth)acrylate, diethylaminoethyl (meth)acrylate, dimethylaminopropyl(meth)acrylate, diethylaminopropyl (meth)acrylate], a di$C_{1-4}$alkylamino-$C_{2-3}$alkyl group-substituted aromatic vinyl compound or a salt thereof [e.g., 4-(2-dimethylaminoethyl)styrene, 4-(2-dimethylaminopropyl)styrene], a nitrogen-containing heterocyclic monomer or a salt thereof [e.g., vinylpyridine, vinylimidazole, vinylpyrrolidone]. As the salt, there may be mentioned a hydrohalogenic acid salt (e.g., hydrochloride, hydrobromide), a sulfate, an alkylsulfate (e.g., methylsulfate, ethylsulfate), an alkylsulfonate, an arylsulfonate, a carboxylate (e.g., acetate). Incidentally, a quaternary ammonium salt group may be formed by reacting a tertiary amino group with an alkylating agent (e.g., epichlorohydrin, methyl chloride, benzyl chloride).

The cationic monomer (e.g., a monomer having a tertiary amino group or salt thereof group, a monomer having or capable of forming a quaternary ammonium salt group) may be copolymerized with the monomer containing a crosslinking functional group to obtain a cationic polymer (a crosslinking polymer) having a crosslinking group, and fixability, water resistance and the like may be improved by using thus obtained polymer.

The hydrophilic monomer includes a copolymerizable monomer having a hydrophilic group such as a carboxyl group, an acid anhydride group, a hydroxyl group, an amide group, a sulfonic acid group, an ether group, a polyoxyalkylene group and the like.

As the carboxyl group-containing monomer, there may be mentioned an unsaturated carboxylic acid or an acid anhydride thereof such as (meth)acrylic acid, itaconic acid, maleic acid, maleic anhydride, fumaric acid, and crotonic acid, and a salt thereof (e.g., an alkali metal salt, an alkaline earth metal salt, an ammonium salt, an amine salt), a half-ester of an unsaturated polycarboxylic acid or a acid anhydride thereof with a linear or branched alcohol having about 1 to 20 carbon atom(s) (e.g., monomethyl malate, monoethyl malate, mono2-ethylhexyl malate).

As a hydroxyl group-containing monomer, there may be mentioned a hydroxyalkyl ester of an unsaturated fatty acid [e.g., a mono- or dihydroxy$C_{2-6}$alkyl ester of a carboxylic acid, for example, a hydroxy$C_{2-6}$alkyl (meth)acrylate such as 2-hydroxyethyl (meth)acrylate, 2-hydroxypropyl (meth) acrylate, 3-hydroxypropyl (meth)acrylate, and 4-hydroxybutyl (meth)acrylate, a mono- or dihydroxy$C_{2-6}$alkyl malate such as 2-hydroxyethylmethyl malate and di(2-hydroxypropyl) malate], an aliphatic, alicyclic or aromatic vinyl compound having a hydroxyl group (e.g., α-hydroxystyrene).

As an amido group-containing monomer, there may be mentioned a $C_{2-8}$carboxylic amide which may be substituted with a substituent such as a $C_{1-4}$alkyl group, a $C_{1-4}$alkoxy group, a $C_{1-4}$acyl group and the like [e.g., a (meth) acrylamide or a derivative thereof such as (meth)acrylamide, α-ethyl(meth)acrylamide, N-methyl(meth)acrylamide, N-butoxymethyl(meth)acrylamide, diacetone (meth) acrylamide].

As sulfonic acid group-containing monomer, there may be mentioned such as an aliphatic, an alicyclic or an aromatic vinyl compound having a sulfonic acid group such as styrenesulfonic acid and vinylsulfonic acid, or a sodium salt thereof.

As an ether group-containing monomer, there may be mentioned a vinyl ether such as vinyl methyl ether, vinyl ethyl ether, and vinyl isobutyl ether.

As a polyoxyalkylene group-containing monomer, there may be mentioned diethylene glycol mono(meth)acrylate, triethylene glycol mono(meth)acrylate, a polyethylene glycol mono(meth)acrylate.

The hydrophilic monomer can be used singly or in combination.

The preferred hydrophilic monomer includes a carboxyl group-containing monomer, in particular, a (meth)acrylic acid or its salt (e.g., a sodium salt, a potassium salt), a hydroxyl group-containing monomer [e.g., 2-hydroxylethyl (meth)acrylate, hydroxypropyl (meth)acrylate], a polyoxyalkylene unit-containing monomer [e.g., diethylene glycol mono(meth)acrylate, triethylene glycol mono(meth) acrylate, a polyethylene glycol mono(meth)acrylate].

The crosslinking functional group-containing monomer, the cationic functional group-containing monomer and the hydrophilic monomer can be used singly or in combination.

The monomer may be used in combination with a nonionic monomer in order to adjust the film-formability or film-formable properties.

As the nonionic monomer, there may be mentioned, for example, an alkyl ester [e.g., a $C_{1-18}$alkyl ester of (meth) acrylic acid such as methyl (meth)acrylate, ethyl (meth) acrylate, propyl (meth)acrylate, isopropyl (meth)acrylate, n-butyl (meth)acrylate, isobutyl (meth)acrylate, t-butyl (meth)acrylate, hexyl (meth)acrylate, octyl (meth)acrylate, 2-ethylhexyl (meth)acrylate, lauryl (meth)acrylate, and stearyl (meth)acrylate], a cycloalkyl ester [e.g., cyclohexyl (meth)acrylate], an aryl ester [e.g., phenyl (meth)acrylate], an aralkyl ester [e.g., benzyl (meth)acrylate], an aromatic vinyl compound [e.g., styrene, vinyl toluene, α-methyl styrene], a vinyl ester [e.g., vinyl acetate, vinyl propionate, vinyl versatate], an allyl ester [e.g., allyl acetate], a halogen-containing monomer [e.g., vinylidene chloride, vinyl chloride], a vinyl cyanide [e.g., (meth)acrylonitrile], an olefin [e.g., ethylene, propylene].

The nonionic monomer can be used singly or in combination.

As the nonionic monomer, usually, a $C_{1-18}$alkyl ester of (meth)acrylic acid [in particular, a $C_{2-10}$alkyl ester of acrylic acid, a $C_{1-6}$alkyl ester of methacrylic acid], an aromatic vinyl compound [in particular, styrene], a vinyl ester [in particular, vinyl acetate] can be used.

The thermosetting or crosslinking resin may comprise a copolymer of the crosslinking functional group-containing monomer (the monomer containing a crosslinking functional group) and if necessary, at least one monomer selected from the group consisting of the cationic functional group-containing monomer, the hydrophilic monomer and the nonionic monomer (in particular, the cationic functional group-containing monomer). Preferably, the thermosetting or crosslinking resin may be a copolymer of the monomer containing a crosslinking functional group, the cationic functional group-containing monomer, and further, at least one monomer selected from the group consisting of the hydrophilic monomer and the nonionic monomer (in particular, the hydrophilic monomer).

The preferred combinations of the monomers are as follows:

Crosslinkable (crosslinking) monomer: a silyl group-containing (meth)acrylate, for example, a (meth) acryloyloxy-$C_{2-3}$alkyltri$C_{1-2}$alkoxysilane Cationic functional group-containing monomer: a di$C_{1-4}$alkylamino-$C_{2-3}$alkyl(meth)acrylate or a quaternary ammonium salt thereof Hydrophilic monomer: an unsaturated carboxylic acid A polymerization manner of a copolymer composed of the above monomers is not particularly limited, and the copolymer may be, for example, a random copolymer or the like.

In the total monomers, the amount of the monomer containing a crosslinking functional group is about 0.1 to 20% by weight, preferably about 0.1 to 10% by weight, and more preferably about 1 to 5% by weight, and the amount of the monomer containing a cationic functional group is about 1 to 50% by weight, preferably about 5 to 45% by weight, and the amount of the hydrophilic monomer is about 0 to 30% by weight (e.g., about 0.1 to 30% by weight), preferably about 0.1 to 20% by weight, and more preferably about 0.5 to 15% by weight, and the balance comprises the nonionic monomer.

In the preferred embodiment, as to the amount of the monomers, the amount of the cationic functional group-containing monomer is about 300 to 1,000 parts by weight and preferably about 500 to 800 parts by weight, and the amount of the hydrophilic monomer is about 100 to 500 parts by weight and preferably about 200 to 300 parts by weight relative to 100 parts by weight of the monomer containing a crosslinking functional group.

The form of the thermosetting or crosslinking resin may be a solution such as an organic solvent solution and an aqueous solution, and is usually an emulsion (in particular, an aqueous emulsion). An emulsion containing a crosslinking polymer can be obtained by a conventional method, for example, a method which comprises emulsion-polymerizing the monomers in the emulsion-polymerization system containing a nonionic surfactant and/or a cationic surfactant, or a method which comprises polymerizing the monomers followed by forming a tertiary amine salt or a quaternary ammonium salt to obtain an aqueous emulsion.

Incidentally, the thermosetting or crosslinking resin, the urethane-series resin and the hydrophilic polymer may be employed in combination, for example, by previously mixing them. Moreover, the thermosetting or crosslinking resin and the urethane-series resin may be used in a form of a composite or a complex obtainable by a process which comprises emulsion polymerizing a monomer composed of an acrylic monomer (in particular, a cationic monomer) in the presence of a urethane-series resin emulsion. The thermosetting or crosslinking resin can be used singly or in combination.

Further, it is particularly preferred that the hydrophilic polymer and the urethane-series resin are employed in combination. The ratio (weight ratio) of the hydrophilic polymer relative to the urethane-series resin is about 90/10 to 10/90, preferably about 70/30 to 30/70, and more preferably about 60/40 to 40/60.

(Dye Fixing Agent)

Further, the transfer layer may contain a cationic compound (dye fixing agent having a low molecular weight) or a polymeric dye fixing agent as a dye fixing agent in order to improve a fixability of a coloring agent (dye). In particular, in the film-formable (film-forming) resin component, when a cationic monomer is not introduced to the resin, it is preferred that the dye fixing agent is employed. The dye fixing agent can be used singly in combination. Among these dye fixing agents, a cationic compound, in particular, a quaternary ammonium salt is preferred.

(1) Cationic Compound

The cationic compound includes an aliphatic amine salt, a quaternary ammonium salt (e.g., an aliphatic quaternary ammonium salt, an aromatic quaternary ammonium salt, a heterocyclic quaternary ammonium salt). The cationic compound can be used singly or in combination. Among them, the preferred cationic compound includes an aliphatic quaternary ammonium salt (e.g., a tetra$C_{1-6}$alkylammonium halide such as tetramethylammonium chloride, tetraethylammonium chloride, tetramethylammonium bromide and tetraethylammonium bromide, a tri$C_{1-6}$alkyl$C_{8-20}$alkylammonium halide such as trimethyllaurylammonium chloride and trimethyllaurylammonium bromide, a di$C_{1-6}$alkyldi$C_{8-20}$alkylammonium halide such as dimethyldilaurylammonium chloride and dimethyldilaurylammonium bromide), especially a tetra$C_{1-4}$alkylammonium halide (e.g., a tetra$C_{1-2}$alkylammonium halide), a tri$C_{1-4}$alkyl$C_{10-16}$alkylammonium halide (e.g., a tri$C_{1-2}$alkyl$C_{10-14}$alkylammonium halide), a di$C_{1-4}$alkyldi$C_{10-16}$alkylammonium halide (e.g., a di$C_{1-2}$alkyldi$C_{10-14}$alkylammonium halide). The aliphatic amine salt is commercial available, for example, as ACKTECHS FC-7 (manufactured by MORIN CHEMICAL, Co. Ltd.), and the quaternary ammonium salt is commercial available, for example, as CATIOGEN L (manufactured by Daiichi Kogyo Seiyaku, Co. Ltd.).

(2) Polymeric Dye Fixing Agent

The polymeric dye fixing agent usually has a cationic group (in particular, a strong cationic group such as a guanidyl group and a quaternary ammonium salt group) in its molecule.

As the polymeric dye fixing agent, there may be mentioned, for example, a dicyane-series compound (e.g., a dicyanediamide-formaldehyde polycondensate), a polyamine-series compound [e.g., an aliphatic polyamine such as diethylenetriamine, an aromatic polyamine such as phenylenediamine, a condensate of a dicyandiamide and a (poly)$C_{2-4}$alkylenepolyamine (e.g., a dicyanediamidediethylenetriamine polycondensate)], and a polycationic compound. As the polycationic compound, there may be mentioned, for example, an epichlorohydrine-di$C_{1-4}$alkylamine addition polymer (e.g., an addition polymer of an epichlorohydrine-dimethylamine), a polymer of an allylamine or its salt (e.g., a polymer of an allylamine or its salt, a polymer of a polyallylamine or its hydrochloride), a polymer of a diallyl$C_{1-4}$alkylamine or its salt (e.g., a polymer of a diallylmethylamine or its salt), a polymer of a diallyldi$C_{1-4}$alkylammonium salt (e.g., a polymer of a diallyldimethylammonium chloride), a copolymer of a diallylamine or its salt with a sulfur dioxide (e.g., a diallylamine salt-sulfur dioxide copolymer), a diallyldi$C_{1-4}$alkylammonium salt-sulfur dioxide copolymer (e.g., a diallyldimethylammonium salt-sulfur dioxide copolymer), a copolymer of a diallyldi$C_{1-4}$alkylammonium salt with a diallylamine or its salt, or its derivative (e.g., a copolymer of a diallyldimethylammonium salt-diallylamine hydrochloride derivative), a polymer of diallyldi$C_{1-4}$alkylammonium salt (e.g., a polymer of diallyldimethylammonium salt), a polymer of dialkylaminoethyl(meth)acrylate quaternary salt [e.g., a polymer of di$C_{1-4}$alkylalkylaminoethyl(meth) acrylate quaternary salt], a diallyldi$C_{1-4}$alkylammonium salt-acrylamide copolymer (e.g., a diallyldimethylammonium salt-acrylamide copolymer), an amine-carboxylic acid copolymer and the like. The polymeric dye fixing agent can be used singly or in combination.

The ratio of the dye fixing agent is, on solid basis, about 1 to 200 parts by weight (e.g., about 1 to 50 parts by weight), preferably about 5 to 150 parts by weight (e.g., about 5 to 40 parts by weight), more preferably about 10 to 100 parts by weight (e.g., about 10 to 30 parts by weight), and usually about 10 to 60 parts by weight relative to 100 parts by weight of the film-formable resin component.

(Additives)

If necessary, the transfer layer may contain a variety of additives, for example, the other dye fixing agents, stabilizers (e.g., antioxidants, ultraviolet ray absorbers, thermal stabilizers), antistatic agents, flame retardants, lubricants, antiblocking agents, fillers, coloring agents, antifoaming agents, coatability improvable agents, and thickeners. The hot-melt adhesive fine particle may contain adhesion imparting agents (e.g., rosin or its derivative, hydrocarbon-series resins), waxes and the like beside the above additives.

The coating amount of the transfer layer is about 1 to 100 $g/m^2$, preferably about 10 to 60 $g/m^2$ and more preferably about 10 to 50 $g/m^2$ (e.g., about 20 to 40 $g/m^2$). The thickness of the transfer layer is about 5 to 90 $\mu$m, preferably about 10 to 70 $\mu$m, and usually about 5 to 60 $\mu$m (in particular, about 10 to 50 $\mu$m). Incidentally, the thickness of the transfer layer means a minimum thickness of the coating layer formed with the use of a coating agent comprising a hot-melt adhesive fine particle.

Moreover, if necessary, a porous layer, an antiblocking layer, a lubricating layer, an antistatic layer and others may be formed on the transfer layer.

[Protecting Layer]

In the transfer sheet of the present invention, a protecting layer which is capable of separating from the support may be disposed between the support and the transfer layer. The protecting layer may be disposed between the support and the transfer layer, and has a role of protecting the transfer layer after transferring on an object. In particular, washing resistance is dramatically improved by disposing the protecting layer.

As the protecting layer, a variety of thermoplastic resins and thermosetting resins, in particular, a polymer having film-formable properties (especially, a polymer having non-adhesiveness, flexibility and suppleness) can be employed as far as the protecting layer is capable of separating from the support and protecting the transfer layer, and the quality of a transfer image is not deteriorated. As the thermoplastic resin, there may be mentioned a variety of resins such as a polyamide-series resin, a polyester-series resin, a styrenic resin, a polyolefinic resin, a polycarbonate-series resin, a polyvinyl acetate-series resin, a acrylic resin, a vinyl chloride-series resin, and a thermoplastic urethane-series resin. As the thermosetting resin, there may be mentioned a urethane-series resin, an epoxy-series resin, a phenolic resin, a melamine-series resin, a urea resin, and a silicone-series resin. Among these resins, a urethane-series resin (e.g., the above thermoplastic urethane-series resin) and/or cationic resin, in particular, a cationic thermoplastic urethane-series resin is preferred since such a resin has high wettability or compatibility toward a support and protects the transfer layer efficiently.

As the urethane-series resin, the above exemplified resins can be employed, and as the thermoplastic urethane-series resin, a polyester-based urethane-series resin obtained with the use of at least a polyester diol as a diol component, especially, a polyester-based urethane-series resin obtained with the use of a diol component containing not less than 50% by weight (e.g., not less than 75% by weight) of an aliphatic polyester diol are preferred. Moreover, if necessary, a diamine component may be used as a chain-extending agent to make a urethane-series resin a thermoplastic elastomer. As the thermoplastic urethane-series elastomer, for example, there may be mentioned an elastomer containing an aliphatic polyether and/or polyester as a soft segment and a polyurethane unit of a short-chain glycol as a hard segment. As the cationic thermoplastic urethane-series resin, there may be mentioned a urethane-series polymer into which the above-exemplified tertiary amino group or the quaternary ammonium salt is incorporated.

The coating amount of the protecting layer is about 0.1 to 20 g/m$^2$, preferably about 1 to 10 g/m$^2$ and more preferably about 1 to 7 g/m$^2$. The thickness of the protecting layer is about 0.1 to 10 $\mu$m, and preferably about 1 to 5 $\mu$m.

[Production Process]

The transfer sheet of the present invention can be produced by forming the transfer layer on at least one side of the support. The transfer layer can be formed by coating a release surface of the support with a coating agent comprising a hot-melt adhesive particle, a film-formable resin component, and if necessary other components (e.g., a dye fixing agent). The film-formable resin component can be usually used in the form of an aqueous solution or an emulsion. Therefore, the coating agent for a transfer layer can be prepared by mixing an aqueous solution or emulsion containing a film-formable resin component with a hot-melt adhesive particle, if necessary, further with the other components. A solvent for an aqueous solution or an aqueous emulsion may be water only, or may optionally contain a hydrophilic organic solvent such as an alcohol.

When a protecting layer is formed, the transfer layer can be formed by coating a release surface of the support with a coating agent for a protecting layer comprising a urethane-series resin and the like, if necessary drying to form the protecting layer, and further by coating the protecting layer with the coating agent for the transfer layer.

The coating agent can be applied (or coated) on at least one side of the support by a conventional method such as roller coating, air knife coating, blade coating, rod coating, bar coating, comma coating or graver coating. The transfer layer can be formed by drying the coating layer at a temperature of about 50 to 150° C., preferably about 60 to 120° C., and more preferably about 70 to 100° C. (particularly about 70 to 90° C.).

The transfer layer formed by the above method is suitable for a method which comprises adhering an ink composition to a recording medium to form an image on the recording medium, for example, a method (an ink jet printing (recording) system) which comprises ejecting droplets of ink (in particular, aqueous ink) to form an image on a recording medium. A record image can be smoothly transferred or conveyed to an object by applying an appropriate pressure (e.g., about 500 to 50,000 Pa) at an appropriate temperature (e.g., about 140 to 250° C., preferably about 140 to 200° C.) for an appropriate period (e.g., about 5 seconds to 1 minute) with the transfer layer contacted with the object, and then peeling the transfer layer (or the protecting layer) from the support. If necessary, a transfer material containing the transfer image may be heated for crosslinking.

As the object to be transferred, there may be mentioned two-dimensional or three-dimensional structures made of various materials such as fibers, papers, woods, plastics, ceramics and metals. Fabrics (e.g., T-shirts), plastic films or sheets, paper, and others may be usually employed as the object. Among the objects, in particular, clothes such as T-shirts are preferred since the transfer sheet of the present invention is excellent in texture and washing resistance.

The transfer sheet of the present invention has excellent stability in delivery of the sheet and prevents the inside of the printer from staining, and is such excellent in ink-absorption to a degree that the stain transfer does not occur. Moreover, because of being excellent in thermal transferability and adhesiveness, the transfer sheet is useful in forming a transfer image on an object. Furthermore, since the transfer sheet is excellent in water resistance (washing resistance), and the transfer image having excellent texture can be formed in the case of thermal-transferring on an object such as clothes and fabrics, the transfer sheet is suitable for transferring on clothes such as T-shirts.

EXAMPLES

The following examples are intended to describe this invention in further detail and should by no means be interpreted as defining the scope of the invention. Incidentally, unless otherwise indicated, "part(s)" indicates the proportion by weight. Moreover, the species or characteristics of each component comprised in the transfer layer of the transfer sheets obtained in Examples and Comparative Examples and methods for evaluating various capabilities or properties of the transfer sheets are shown as follows.

(Characteristics of Each Component Comprised in Transfer Layer)

- Nylon 6/12 fine particle A1: manufactured by Atofina Japan, Co. Ltd., ORGASOL 3501EX D NAT-1, oil absorption of 212 ml/100 g, melting point of 142° C., mean particle size of 10 $\mu$m
- Nylon 12 fine particle A2: manufactured by Daicel Huels, Co. Ltd., Bestamelt 430-P06, oil absorption of 45 ml/100 g, melting point of 110° C., mean particle size of 60 $\mu$m
- Nylon 12 fine particle B: manufactured by Daicel Huels, Co. Ltd., Bestamelt 640-P1, melting point of 76° C., mean particle size of 100 $\mu$m
- Urethane-series resin emulsion: manufactured by Shin Nakamura Kagaku, Co. Ltd., SP resin ME-307
- Polyethylene glycol: manufactured by Sanyo Kasei Kogyo, Co. Ltd., PEG4000S Dye fixing agent: manufactured by Senka, Co. Ltd., PAPIOGEN P109, a quaternary ammonium salt-containing compound (Method for Printing)

With the use of an ink jet printer (manufactured by Seiko-Epson, Co. Ltd., PM-800C), on the transfer sheets obtained in Examples and Comparative Examples was individually printed a predetermined image with cyane, yellow, magenta, black, lightcyane and lightmagenta inks to form a record image.

(Method for Transferring)

After printing to a transfer sheet, the transfer sheet laid with the printed side down was placed on a card white T-shirts (manufactured by Arai Seitaro Shoten K.K., L-size). The transfer sheet was ironed from the upper side thereof with loading of 98N (10 kgf) with the use of an iron (manufactured by Toshiba Corporation, TAD23). The ironed time was totally 4 minutes while changing a part to be ironed every 5 seconds. Furthermore, the ironed transfer sheet and T-shirts were cooled down enough, and then the release paper was separated from them.

(Method of Washing)

After transferring, the washing operation was carried out by adding 15 g of a neutral detergent to 15 L of warmed water of 30° C., washing for 15 minutes, rinsing for 11 minutes and drying for 5 minutes. This cycle was repeated 5 times, and then the wash was allowed to dry spontaneously.

(Stability of Coating Layer on Delivery of Sheet)

The defect (or lack) of the coating layer caused by delivery of a sheet on printing was visually observed, and stability of the coating layer on delivery of the sheet was evaluated according to the following criteria.

"A": the coating layer hardly has the defects

"B": there are no problems for the appearance of the transfer sheet, however, a small amount of a stripped coating layer component(s) is adhered to the inside of the printer "C": the coating layer has the defects, and the transfer sheet is got serious line (or stripe) injures (Washing Resistance)

After washing, the transfer image area was observed visually, and the washing resistance was evaluated according to the following criteria.

"A": the transfer image area hardly changes

"B": the transfer image area discolors

"C": the transfer image area is separated from the T-shirts (Spreadability or Permeation by Soaking)

After printing and transferring, the T-shirts was soaked in water at 23° C. for 15 seconds, and pulled up quickly, and then suspended it to allow to dry spontaneously. The degree of the spreadability or permeation was visually observed and evaluated according to the following criteria.

"A": spreadability or permeation of the ink is hardly occurred

"B": there is a little spreadability or permeation in yellow

"C": all colors are spread or permeated, and the fabric discolors.

(Stain Transfer)

After printing, the transfer sheet was visually observed whether the stain transfer was found or not on the transfer sheet, and the degree of the stain transfer was evaluated according to the following criteria.

"A": no stain transfer

"B": a slight stain transfer is found

"C": terrible stain transfer is found (Successive or Continuous Delivery of a Sheet)

Ten (10) sheets were printed successively or continuously, and the degree of undersupply (e.g., the sheet was not supplied or delivered, or the sheet clogged) was evaluated according to the following criteria.

"A": no undersupply

"B": two or less pieces of the sheet are not supplied

"C": the sheet cloggs, or three or more sheets are not supplied (Red Color Development)

An image of early-evening landscape was printed on the transfer sheet. A color of the image after transferring was visually observed and evaluated according to the following criteria.

"A": bright color

"B": slightly somber color

"C": terrible somber and blackish development

Examples 1 to 2 and Comparative Examples 1 to 6

An aqueous coating solution (or coating agent) was prepared by mixing the components in the proportion shown in Table 1 (on solid basis). The aqueous coating solution was coated on a paper for coating (manufactured by Lintec Corporation, BK6RB(S5)) at coating amount of 37 g/m$^2$ and dried at 80° C. to obtain a transfer sheet composed of a transfer layer shown in Table 1. The evaluation results of the obtained transfer sheets are shown in Table 1.

TABLE 1

| | | Examples | | Comparative Examples | | | | | |
|---|---|---|---|---|---|---|---|---|---|
| | | 1 | 2 | 1 | 2 | 3 | 4 | 5 | 6 |
| Transfer layer (parts by weight) | Nylon 6/12 fine particle A1 | 9.4 | 18.4 | — | 55.2 | — | 27.6 | 27.6 | — |
| | Nylon 12 fine particle A2 | 44.1 | 18.4 | 55.2 | — | — | 27.6 | — | 27.6 |
| | Nylon 12 fine particle B | 1.7 | 18.4 | — | — | 55.2 | — | 27.6 | 27.6 |
| | Urethane-series resin emulsion | 20.9 | 20.9 | 20.9 | 20.9 | 20.9 | 20.9 | 20.9 | 20.9 |
| | Polyethylene glycol | 15.4 | 15.4 | 15.4 | 15.4 | 15.4 | 15.4 | 15.4 | 15.4 |
| | dye fixing agent | 8.5 | 8.5 | 8.5 | 8.5 | 8.5 | 8.5 | 8.5 | 8.5 |
| Performance | Stability of coating layer on delivery of sheet | A | A | C | C | A | C | A | A |
| | Washing resistance | A | B | A | B | C | A | B | A |
| | Spreadability or permeation by soaking | A | A | A | A | A | A | A | A |
| | Stain transfer | A | A | C | A | C | A | A | C |
| | Successive or continuous delivery of sheet | A | B | B | B | C | B | B | B |
| | Red color development | A | B | A | C | A | B | B | A |

As apparent from Table 1, the transfer sheets of Examples 1 to 2 are excellent in a balance of each performance. On the contrary, since the transfer sheets of Comparative Examples 1 and 6 do not comprise three kinds of nylon fine particles, these transfer sheets are deteriorated in a balance of each performance.

What is claimed is:

1. A transfer sheet comprising a support, and a transfer layer separable from the support and receivable an ink, wherein the transfer layer contains a hot-melt adhesive particle, the particle comprises a particle having a melting point of more than 80° C. (A) and a particle having a melting point of not more than 80° C. (B), and the particle (A) comprises a hot-melt adhesive particle having an oil absorption of not less than 50 ml/100 g (A1) and a hot-melt adhesive particle having an oil absorption of less than 50 ml/100 g (A2).

2. A transfer sheet according to claim 1, wherein the melting point of the particle (A) is 90 to 120° C., and the melting point of the particle (B) is 30 to 80° C.

3. A transfer sheet according to claim 1, wherein the oil absorption of the particle (A1) is 70 to 500 ml/100 g, and the oil absorption of the particle (A2) is not more than 48 ml/100 g.

4. A transfer sheet according to claim 1, wherein the weight ratio of the particle (A) relative to the particle (B) is 99.9/0.1 to 30/70.

5. A transfer sheet according to claim 1, wherein the weight ratio of the particle (A1) relative to the particle (A2) is 80/20 to 1/99.

6. A transfer sheet according to claim 1, wherein the particle (A) and the particle (B) each comprise a polyamide-series particle.

7. A transfer sheet according to claim 1, wherein the transfer layer further comprises a film-formable resin component.

8. A transfer sheet according to claim 7, wherein the film-formable resin component comprises at least one member selected from the group consisting of a hydrophilic polymer, a urethane-series resin and a thermosetting or crosslinkable resin.

9. A transfer sheet according to claim 1, wherein the transfer layer further comprises a dye fixing agent.

10. A transfer sheet according to claim 1, wherein the transfer layer further comprises a film-formable resin component and a dye fixing agent, and the transfer layer comprises 10 to 10,000 parts by weight of the hot-melt adhesive particle and 1 to 200 parts by weight of the dye fixing agent relative to 100 parts by weight of the film-formable resin component.

11. A method for recording or forming an image onto a recording medium with an ink composition, wherein the recording medium comprises a transfer layer of a transfer sheet recited in claim 1.

12. A method according to claim 11, wherein the image is formed by ejecting droplets of the ink composition.

13. A transfer sheet according to claim 1, wherein an image is recorded onto the transfer layer of the transfer sheet by an ink jet recording system.

14. A method for transferring a record image to an object, which comprises bringing a transfer layer of a transfer sheet recited in claim 13 into contact with the object, heating the transfer layer, and peeling the transfer layer from a support for transferring the record image to the object.

15. A fabric or clothes, on which a record image is formed by a transferring method recited in claim 14.

16. A transfer sheet comprising a support, and a transfer layer separable from the support and containing a hot-melt adhesive particle, wherein the transfer layer comprises (A) a polyamide-series hot-melt adhesive particle having a melting point of 100 to 120° C., (B) a polyamide-series hot-melt adhesive particle having a melting point of 60 to 80° C., a polyoxyalkylene glycol-series resin, a polyester-based urethane-series resin, and a cationic compound, and the particle (A) comprises a hot-melt adhesive particle having an oil absorption of 100 to 300 ml/100 g (A1) and a hot-melt adhesive particle having an oil absorption of not more than 47 ml/100 g (A2), the weight ratio of the particle (A) relative to the particle (B) is 99.5/0.5 to 50/50, the weight ratio of the particle (A1) relative to the particle (A2) is 60/40 to 5/95, and the transfer sheet comprises 10 to 5,000 parts by weight of the hot-melt adhesive particle and 5 to 150 parts by weight of the cationic compound relative to 100 parts by weight of the total amount of the polyoxyalkylene glycol-series resin and the polyester-based urethane-series resin.

* * * * *